United States Patent [19]

Fishler

[11] Patent Number: 4,515,290

[45] Date of Patent: May 7, 1985

[54] ARTICLE DISPENSING APPARATUS

[76] Inventor: Jay Fishler, 39 Artisan Ave., Huntington, N.Y. 11743

[21] Appl. No.: 501,263

[22] Filed: Jun. 6, 1983

[51] Int. Cl.[3] ..... B65G 59/06

[52] U.S. Cl. ..... 221/124; 221/191; 221/226

[58] Field of Search ..... 221/191, 193, 194, 279, 221/280, 303, 307, 309, 311, 312 R, 312 B, 312 C, 226, 227, 92, 175, 241, 242, 231, 232; 211/49 D, 49 S; 312/61, 71; 206/44.12, 45.11, 45.16

[56] References Cited

U.S. PATENT DOCUMENTS

| | | | |
|---|---|---|---|
| 340,355 | 4/1886 | Ramser | 221/59 |
| 2,893,596 | 7/1959 | Gabrielsen | 221/227 |
| 3,957,174 | 5/1976 | Palamara | 206/44.12 |

FOREIGN PATENT DOCUMENTS

| | | | |
|---|---|---|---|
| 407118 | 3/1934 | United Kingdom | 221/279 |

*Primary Examiner*—Joseph J. Rolla
*Assistant Examiner*—L. Heim
*Attorney, Agent, or Firm*—Bauer & Amer

[57] ABSTRACT

A dispenser for articles comprised of a plurality of laterally interlocking planar partitions with a space between adjacent partitions to form a column for storing the articles to be dispensed. One end of the column defines a customer receiving position for dispensing a last-to-be loaded article from the column. Each column has means that urges the articles towards the customer receiving or dispensing position to hold the last-to-be loaded and first-to-be dispensed article thereat. A slight movement of the article held in the dispensing position causes the same to eject partially therefrom.

12 Claims, 6 Drawing Figures

ARTICLE DISPENSING APPARATUS

BACKGROUND OF THE INVENTION

This invention relates to a dispenser for articles, and more particularly to a machine that stores containers, as lipsticks and the like, and dispenses them with pop-out action.

Apparatuses for advancing and dispensing containers and other articles are known as illustrated and disclosed in the following U.S. Pat. Nos. to Ramser 340,355, Repko 3,164,298, Zorner 3,204,816, Lisben et al 3,861,563, Strauss 4,018,360, and Collins et al 4,134,520 and 4,200,201.

Some of the prior art apparatuses simply employ a container which relies upon a gravity feed. Such apparatuses are frequently subject to article feed problems in which the articles tilt or bind against walls to become stuck before being dispensed thereby rendering them difficult to use and operate. Some apparatuses overcome these problems by using involved arrangements of movable trays, platforms, bales, conveyors and the like. Their large number of interacting moving parts make them relatively expensive and add volume to the apparatus. This results in a reduction in the volume of articles the machine may hold and dispense.

The present invention overcomes many of the drawbacks associated with earlier machines. In general, the present inventive dispenser comprises a plurality of laterally interlocking planar partitions. Each of the partitions has a frontward and rearward edge and an upper and lower edge. The last-mentioned edge is formed with an extension having a profile that depends downwardly therefrom. Each of the frontward and rearward edges is integrally formed with a wall member that is orthogonal to the plane of the partition thus to form a generally T-shaped structure therewith.

The lateral thickness of the wall members on the frontward and rearward edges in conjunction with the front-to-back distance between the same is dimensioned so that when the partitions are interlocked, the transverse cross-sectional area defined in the space between adjacent partitions is complementary in size to the article being stored and thus defines an article storing space. The frontward and rearward walls near the lower edge of the partitions are formed with complementary stepped angulated ramps to define display and dispensing or customer receiving positions.

A movable pusher tray is disposed in the article storing space and adapted to slide therein and relative thereto. A spring in the form of a coiled tape has one end attached to the tray. The other end of the tape remains coiled and is held in a pocket near the lower edge of the partition outboard of the storage space. The coiled spring urges the tray to apply a pushing pressure on the articles loaded into the space to hold the last-to-be-loaded article in the display position and in the dispensing or customer receiving position. The articles to be dispensed are loaded through the dispensing or customer receiving position to be held in the storage space in clip-like, vertical array. The tray pushes on the loaded stack of articles holding the last-to-be-loaded article in the display position, between the frontal stop and the rearward holding step.

To dispense an article, one merely pulls slightly on the forward distal end of the display article in the display position. This causes the rearward end of the article to pivot minutely on the holding step slightly lifting the array of stacked articles while the frontal end of the article moves out of engagement with the frontal stop. The action of the pushing tray causes it to pop out of the display position and pivots it free into the dispensing position for manual removal from the dispenser.

With the inventive dispenser, an array of any number of separated dispensing compartments can be easily made. No special tools are required to assemble the inventive apparatus, and when so assembled, the apparatus is easily loaded and reloaded with the articles to be dispensed.

It is therefore an object of the present invention to provide a display case and dispenser that is fabricated from a plurality of interlocking partitions.

It is a further object of the present invention to provide a display case and dispenser that can be made to store and dispense various types of articles, including lipstick containers in discrete, separated columns and which, when empty, can be reloaded quickly and easily.

It is another object of the present invention to provide a display case and dispenser for articles which dispenses the same without movable carriages and troughs, and so maximises the volume of the product being stored to the volume of the storage apparatus.

It is a further object of the present invention to provide a dispenser for lipstick containers which holds the articles to be dispensed in a spring loaded condition and wherein the articles are adapted to pop partially outward therefrom when moved in a dispensing direction.

It is another object of the present invention to provide a dispenser which is simple in operation, attractive in appearance, and low in cost.

Other objects and features of the present invention will become apparent from the following detailed description considered in connection with the accompanying drawings. It is to be understood, however, that the drawings are designed for purposes of illustration only, and not as a definition of the limits of the invention for which reference should be made to the appending claims.

BRIEF DESCRIPTION OF THE DRAWINGS

In the drawings, wherein the same reference numeral denotes the same element throughout the several views.

DESCRIPTION OF THE INVENTION

Figure 1:
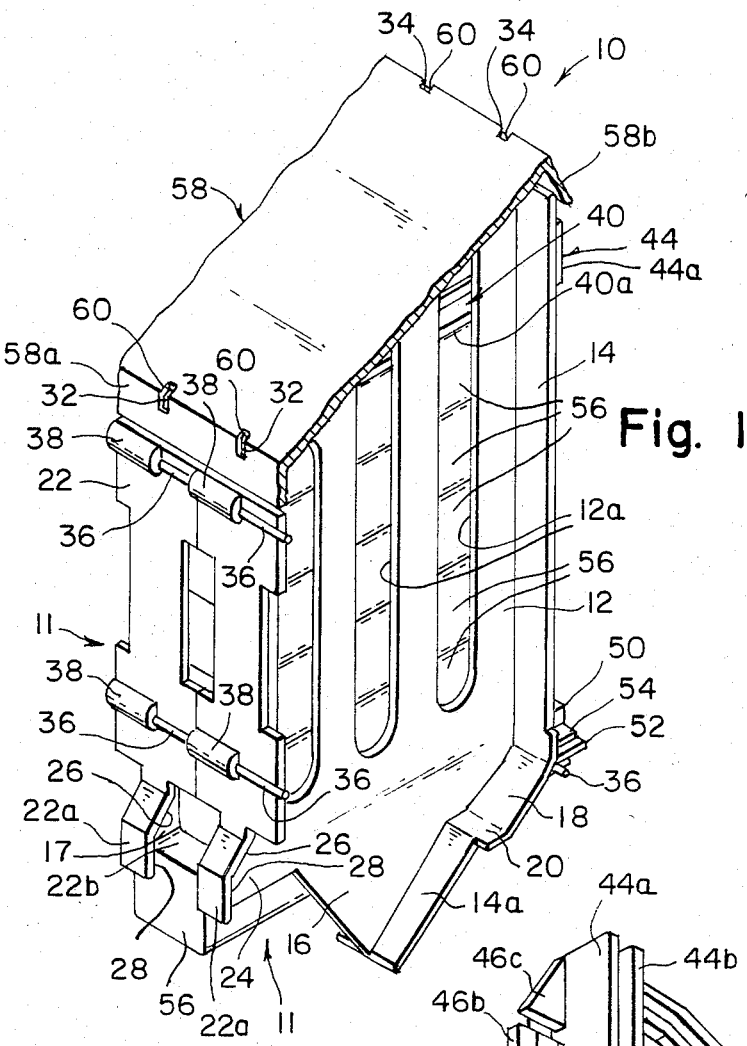
FIG. 1 is a frontal perspective view of the inventive dispenser apparatus.

Referring now to the drawings there is shown the inventive dispenser apparatus which is indicated generally by reference numeral 10. The dispenser apparatus 10 is comprised of a plurality of interlocking partitions 11 each of which has a partition wall 12 that is formed with a plurality of weight and cost reducing cut-outs or spaces 12*a*. The rearward vertical edge of each partition wall 12 is formed with an integral rear wall 14 the plane of which is perpendicular to the plane of its partition wall 12 and is bifurcated thereby so that when looking transversely as in FIG. 5, wall 14 and partition 12 form a generally T-shaped structure. The lateral width of wall 14 is dimensioned so that when the partitions 11 are assembled as will be described, the facing contiguous edges of the walls 14 define a guide slot 15.

Figure 4:
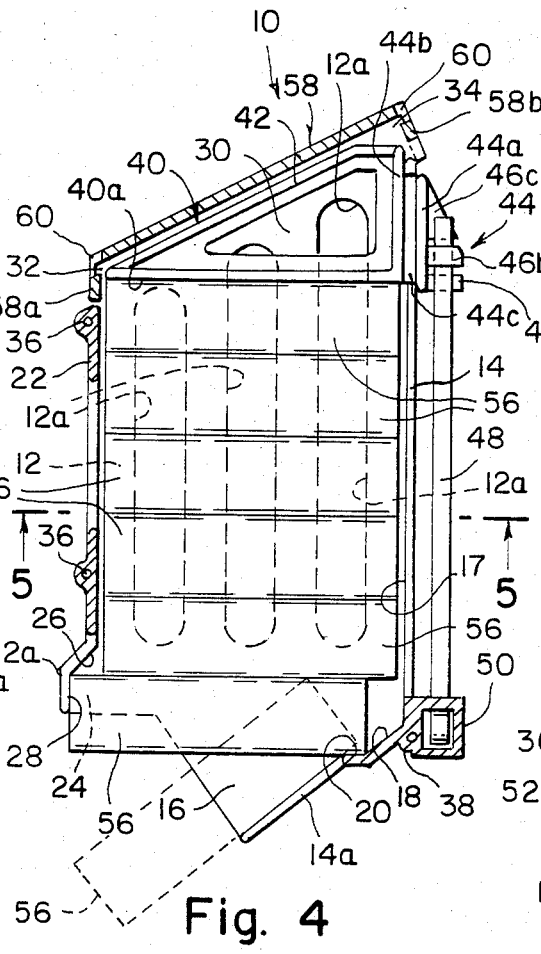
FIG. 4 is a vertical sectional view taken in the direction of lines 4—4 of FIG. 3.

In referring to FIGS. 1 and 4, it will be seen that the lower part of partition wall 12 includes a continuous, integrally formed dispensing shelf or extension 16 which is directed downward and is bordered by a continuation 14*a* of the wall 14 that is integral therewith. Both the rearward edge of extension 16 and its integrally formed wall part 14*a* are formed with a step-like profile comprised of an inclined rear feed surface or guide ramp 18 that merges into and forms a planar receiving step, landing or stop 20. The part of wall 14*a* extending from the step 20 is laterally narrower on either side of the extension 16 than it is in the area of the ramp 18 and step or landing 20.

The forward vertical edge of each partition 12 is formed with an integral wall 22, the plane of which is perpendicular to the plane of its corresponding partition 12. As with rear wall 14, the position of partition 12 with respect to forward wall 22 is such that the former bifurcates the latter so that when looking transversely at this construction, as in FIG. 5, wall 22 and partition 12 form a generally T-shaped structure. When looking at FIG. 4 it will be seen that the lower portion of partition 12 is formed with an integral extension 24 that projects beyond the remainder of the leading forward edge of partition 12. The forward edge of extension 24 carries an integral extension 22*a* of the wall 22.

Figure 2:
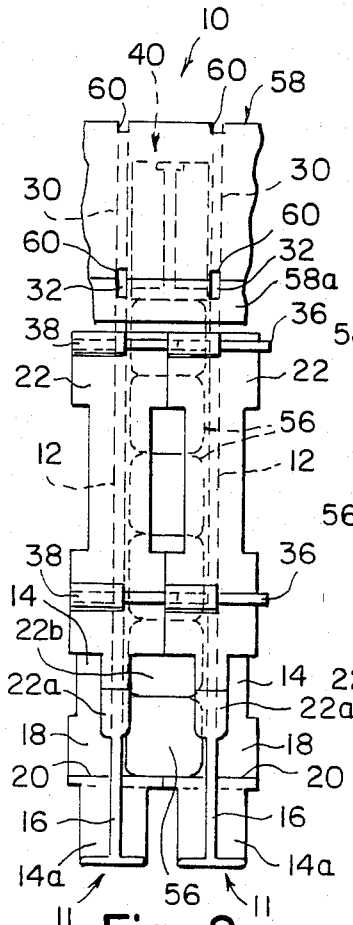
FIG. 2 is a front elevational view of the apparatus of FIG. 1.

It will also be seen from FIG. 4 that the forward edge of extension 24 and its complementary formed wall part 22*a* is configured with a small step-like profile comprised of a forward or leading ramp 26 that merges into a downwardly disposed wall guide or forward article dispensing stop 28. As will be discussed, the linear front-to-back dimensions between wall stop 28 and planar landing 20 are such as to provide the customer receiving position for the articles to be dispensed. Further, it will be observed that wall part 22*a* has a transverse or lateral width smaller or less than that of the remainder of the wall 22 and thus adjacent facing wall parts 22*a* are spaced apart and form a display window or opening 22*b* as can be seen in FIG. 2.

The uppermost edge 30 of partition 12 is disposed at an angle in angulated position to extend from and between wall 22 to wall 14. The forward edge of partition 12 immediately above the upper marginal end of forward wall 22 is formed with latching nib 32. The rearward edge of partition 12 immediately above rear wall 14, near the apex formed by the angulated position of edge 30, is also formed with a nib 34.

The means for detachably interlocking the partitions into a ganged, stackable side-by-side array includes a plurality of spaced pins 36 formed by being molded integral on and projecting laterally a short distance from one side of walls 22 and 14. Thus, an array of pins 36 extends laterally from one side of walls 22 and 14 whereby the axis of the pins is substantially orthogonal to the plane of partition 12, with each pin oriented in the same direction. A plurality of complementary positioned pin-receiving apertures 38 are formed on the other side of walls 22 and 14. Each pin 36 is adapted to be received in a complementary or associated pin-receiving aperture 38 when the partitions 12 are joined together.

Figure 5:
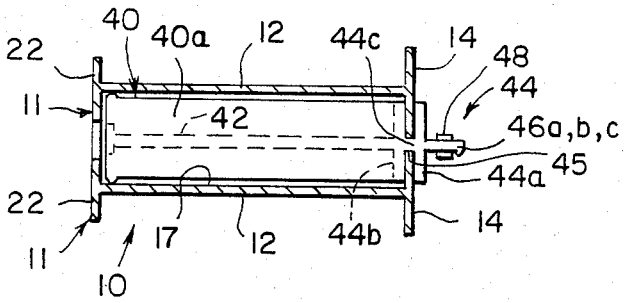
FIG. 5 is a transverse sectional view taken along lines 5—5 of FIG. 4.

A pressure tray generally identified by numeral 40 is located for sliding movement and guided between the article-storing column or space formed between adjacent partitions 12 when the same are assembled in the manner to be described. Tray 40 includes a pressure face 40*a* sized substantially complementary to the transverse width or cross-sectional space between adjacent partitions 12. The other side of tray 40 is formed with a stiffening member 42 while the rearward end of tray 40 includes a guide 44 that comprises a pair of spaced substantially parallel planar guides 44*a* and 44*b* that are separated by a rib 44*c*. Rib 44*c* supports guides 44*a* and 44*b* and is perpendicularly positioned with respect thereto while planar guides 44*a* and 44*b* are disposed perpendicular to the plane of tray 42. The spacing between the planar guides is such so as to accommodate facing contiguous edges of adjacent walls 14 for guiding movement in a slot 45 defined therebetween (FIG. 5).

A projecting extension formed in three relatively spaced parts 46*a, b* and *c* is integrally formed with the outboard face of planar guide 44*b*. A resilient spring element 48 biases tray 40 towards the lower edge of the partition and landing 20. The spring element 48 comprises a tempered steel tape which is preformed into a coil and is generally similar to the type found in retractable tape measures. The temper of the spring 48 is such that when it is unrestrained it will form a closely spirally wound spring coil. One end of tape coil 48 is interlocked by being interwoven between the spaced parts 46*a, b* and *c* to interengage with the parts and wedge in the spaces or slots therebetween to prevent accidental separation therefrom.

Figure 6:
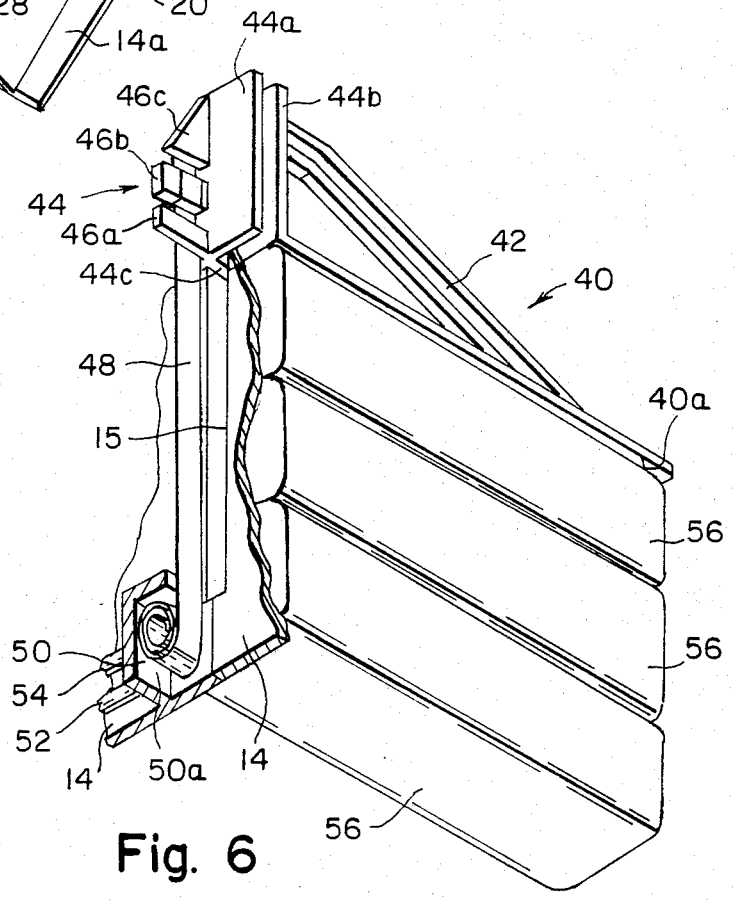
FIG. 6 is a rear perspective view with parts broken away to illustrate diagrammatically the pressurized vertical columnar stacking of lipstick containers.
Figure 3:
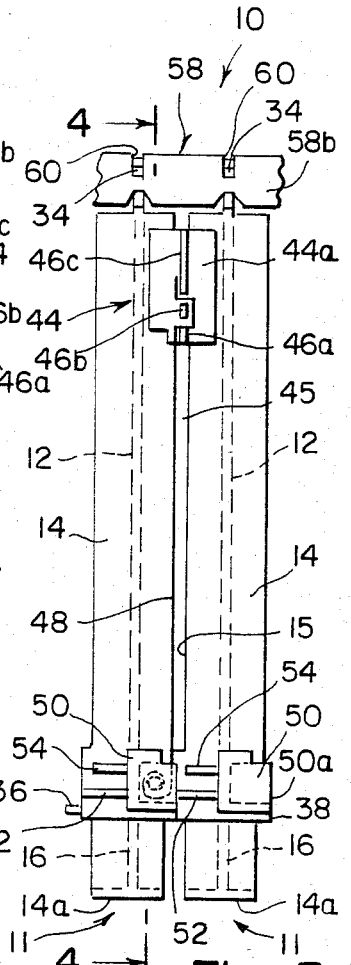
FIG. 3 is a rear elevational view of the apparatus of FIG. 1.

The other, spirally wound end of coil 48 fits into a pocket 50 provided on the lower outboard face of wall 14 near rearward ramp 18 as shown in FIGS. 3, 4 and 6. The pocket 50 is sized so as to receive the coiled end and it can be seen that the pocket is formed with an open face 50*a* that is substantially in line or flush with one edge of wall 14 to enable convenient insertion of the spring thereinto. Extending from the other side of pocket wall 50 and being laterally directed are a plurality of planar fingers 52 and 54 each of which is of length to form a closure for the open side of the next adjacent pocket 50 to retain the spring therein from sideway displacement therefrom. The free, lateral, marginal ends of these fingers insure that the spirally wound end of coil 48 remains seated in the next adjacent pocket 50.

In operation, a pusher tray 40 is positioned between the partitions 12 as the same are assembled. The pusher tray 40 is inserted in the space between adjacent partitions such that its planar guides 44*a* and 44*b* receive the facing edges of adjacent walls 14 as the partitions are moved together in side-by-side array. During this assembly operation, the spirally wound end of coil 48 is inserted into the pocket 50. As the partitions are brought together, a given one of respective pins 36 is received and snap-fit into a complementary positioned pin-receiving aperture 38 to retain the partitions 12 together. As facing pins 36 and apertures 38 seat, fingers 52 and 54 move into pocket closing relationship with the open side of the next adjacent pocket to close the spring therein.

This assembly procedure is then repeated, sequentially, for each additional partition 12 which is to be added to the joined, side-by-side array. And, of course, for each partition 12 added to the array, a pressure-tray 40 is inserted in the article receiving columnar space between the walls 14. It should be apparent that the lateral or transverse width of walls 22 and 14, in conjunction with the front-to-back distance between them, is sized so that when the partitions are joined, the cross-sectional area of the columnar space 17 enclosed thereby, as seen in FIG. 5, is complementary in size generally to the width of the articles to be stored therein and to be dispensed therefrom, as the lipstick containers 56.

When the desired number of partitions are assembled in side-by-side array, a snap-on roof or closure 58, sized to cover the lateral width of the array, is pressed onto the upper ends of each partition to secure and lock them together. This is accomplished by providing a respective number of nib-receiving apertures 60 in the closure roof 58. Furthermore, it will be noticed when viewing FIG. 4 that the closure or locking roof 58 has a forward angulated depending lip **58*b* in which the apertures 60 are formed and are designed to snap onto and to receive respective nibs 32 and 34**, thereby locking the roof thereon.

After the partitions 12 are assembled in the desired number, the articles 56 to be dispensed therefrom are loaded into a given columnar storage space 17. This is accomplished by aligning the article 56, as a lipstick case, rearward end first, and then inserting, by pushing, its rearward end into the space between facing partition extensions 16 of the partition walls 12 toward and onto the inclined ramp 18. Continued pushing insertion of container 56 drives the same against tray face **40*a* thus lifting the tray against the urging bias of the spring 48 and causing the rearward end of the article 56 to come to rest on planar land 20 as seen in FIG. 4. A release of the front end of article 56 with a slight upward push causes the front end of container 56 to snap up and abut against the inner surfaces of the guides 28**.

The downward pressure of pusher tray 40 on the facing surface of the inserted article 56 acts to hold the article in this customer-display position with a portion of the underside of the rearward end of the article supported on land or step 20 and the forward top-like end or face of container 56 resting against the two relatively spaced adjacent guides or stops 28. The next article 56 is then loaded in the same manner, although it should be apparent that when the next article 56 is inserted and pushed onto land 20, it will press against the lower confronting surface of the last-to-be-loaded article 56 in the customer-display position. When this happens, the prior article 56 is lifted off of land 20, and by the guiding action of ramp 26, the lifted article is pushed and moved up into space 17 as the newly loaded container comes to rest in the customer-display position.

In this manner, and as seen in FIG. 6, a given quantity of articles 56 may be stored and stacked in space 17. As each one of the articles is loaded into the columnar space 17, they lift the tray 40 and cause an associated incremental uncoiling of spring 48 from pocket 50. It should now be apparent that each of the column of articles 56 is under constant dispensing pressure from the pusher tray 40. This constantly urges the last-to-be-loaded article 56 into firm engagement with the land 20 thus maintaining the same in the customer-display position as seen in FIG. 4.

Since the coiled end of spring 48 that sits in pocket 50 is free to revolve so as to coil and uncoil, the remote free end of the spring is unrestrained and the force exerted by spring 48 on the tray 40, and hence on the articles 56 stored in column 17, is substantially constant. Moreover, the guides **44*a* and 44*b* in conjunction with rib 44*c* of guide 44 provide a smooth, relatively large planar area along which to ride on adjacent faces of walls 14. Slot 15 in conjunction with rib 44*c* maintains and directs the columnar alignment and movement of the tray in the space 17 under all loading and dispensing configurations. With this construction, tray 40 is restrained from substantial canting with respect to slot 15 and this insures a smooth sliding, moving action of the tray in the storage space 17**.

To dispense an article 56, one merely lightly pushes down, through window **22*b* defined by the space between the wall parts 22*a*, on the leading forward end of container 56 held between stop guides 28. The canted or angulated disposition of extension 16 invites a downward direction of dispensing push towards and into engagement with wall part 14*a* into the broken line dispensing position as shown in FIG. 4. This slight pivotting of the article 56 on land 20 into the customer-dispensing position slightly lifts the column of containers stored above and resting thereon. Since all articles 56 in the column 17 are under constant pressure of tray 40 and coil 48, once the bottom selected article is pivotted free of guides 28 as aforesaid, the pressure exerted by the tray and transmitted by the stacked articles causes the article in the customer-dispensing position to pop out of and partially eject from such position along the angled wall 14*a* for easy removal from the apparatus 10** by the customer.

The next article 56 in the column is then urged automatically by the pusher 40 to drop immediately downwardly in the space 17. Such downward movement causes the rearward edge of the next article to strike rearward ramp 18 and slide downwardly thereon while being guided by forward complementary ramp 26, eventually to come to rest on land 20 on one end, and abuttingly come to rest against guide 28 on the other. This article is now in the customer receiving or display position and ready for selection, dispensing and pop-out ejection as noted above.

Preferably the inventive structure, except for the metallic coiled tape-like spring, is comprised of plastic. When the partitions 12 are assembled, it may be desired to lightly coat pins 36 with a glue to insure that the partitions do not separate. However, if the pins and the pin-receiving apertures into which these pins seat are provided with a precise interference fit, it is possible to lock the partitions together detachably and thus assemble and disassemble the apparatus 10 in accordance with the separable number of articles being displayed and dispensed.

While only a few embodiments of the present invention have been shown and described, it is to be understood that many changes and modifications can be made hereto without departing from the spirit and scope thereof.

What is claimed is:

1. A dispenser for articles comprising a plurality of planar partition means, means for joining said plurality of partition means in spaced side-by-side ganged array whereby when joined, the space between adjacent ones of said partition means defines a column to store in stackable array the articles to be dispensed therefrom, each of said partition means being formed with an extension so that when said partition means are joined adjacent extensions provide an area into which the articles to be dispensed are loaded and also hold the last-to-be-loaded article in display and dispensing positions, means in each column applying a pressure to the articles loaded into the column so that the last-to-be-loaded article is held in the display position for partial ejection therefrom under the application of said pressure applying means and for manual removal and dispensing from the column, said pressure applying means operating to cause the selected article to eject from the display position to the dispensing position when moved slightly relatively thereto, said means for joining said partition means together being releasable and being complementary positioned on adjacent partitions to engage with each other such that when adjacent partitions are placed side by side said joining means engage to lock the same together and release their engagement to enable separation of the partitions upon the application of a separating force to the partitions.

2. A dispenser of claim 1, said means for joining said partition means being in the form of a pin extending from one lateral side of each of said partition means, and complementary positioned aperture means formed on the other lateral side of each of said partition means such that each of said aperture means receiving therein a joining pin of the next adjacent partition means when the partitions are placed side by side to lock the same together.

3. The dispenser of claim 1, said means for applying a pressure comprising a pusher sized to fit slidably in the column and means for biasing said pusher for sliding movement in the direction of said display and dispensing positions.

4. The dispenser of claim 3, said pusher having a part thereof extending external to the column, and a coiled resilient tape having one end attached to said part and another end coiled and constrained from displacement from a column forming partition means.

5. The dispenser of claim 4, a unitary support engaged with each of said joined partition means to hold the same joined together to add rigidity to their ganged array.

6. An apparatus for dispensing articles comprising a plurality of partition members each having a partition wall, lateral walls on and substantially perpendicular to and about the edges of each of said partition walls with one portion of an edge of each of said partition walls being free of said lateral walls, engaging means on certain of said lateral walls joining together adjacent ones of said partition members to form a space between each of their respective partition walls so as to receive articles in said space for dispensing therefrom, said edge portion of each of said partition walls being free of said lateral walls defining an opening therebetween through which articles are inserted into said article receiving space and through which articles in said space are dispensed therefrom, portions of said lateral walls adjacent each said opening having an inclined support surface, a forward stop surface and a forward ramp surface, and a rear stop surface and rear ramp spaced from and complementary to said forward stop and ramp surfaces, resiliently biased means in said article receiving space for applying a dispensing force against articles therein to move the articles toward said complementary spaced ramps and into engagement with said complementary spaced stops to cause the movement of the articles in said space into a display position for engagement with said inclined support surface for dispensing from said apparatus through said opening.

7. An apparatus as in claim 6, said resiliently biased means comprising a pusher tray slidable in said space between said adjacent partition walls and a flat spring attached to said tray at its one end and spirally coiled for resilient extension and retraction at its other end, said coiled end being mounted on a partition member against accidental displacement therefrom.

8. An apparatus as in claim 7, a slot defined between adjacent lateral walls of each partition member, and guide means on each pusher tray having means external of said lateral walls and movable in said slot for guided movement of said pusher tray within said article receiving space.

9. An apparatus as in claim 8, said engaging means for joining said partitions including pin means extending from one side of said lateral walls, aperture means formed in the other side of said lateral walls with each of said pin means adapted to fit into and engage an associated one of said aperture means, and a snap-on top adapted frictionally to engage edges of said partitions free of said lateral walls to cover the same an provide rigidity thereto.

10. An apparatus as in claim 9, the width of said lateral walls being predetermined to define the spacing between said partition walls substantially equal to receive the articles received therebetween.

11. A dispenser for articles comprising a plurality of laterally interlocking planar partitions, each of said partitions having a forward and rearward edge in an upper and lower edge, said last-mentioned edge being formed with an extension having a profile that depends downwardly therefrom, each of said frontward and rearward edges being integrally formed with a wall member that is orthogonal to the plane of the partition to form a T-shape therewith, said wall member on said rearward edge extending along the edge of said extension forming a dispensing area therewith, the lateral thickness of the wall member on said frontward and rearward edges in conjunction with the front-to-back distance between the same being dimensioned so that when said partitions are interlocked, the transverse cross-sectional area defined in the space between adjacent partitions is complementary in size to the size of the articles being stored in said space, said forward and rearward wall near the lower edges of said partitions each being formed with complementary step-like angulated ramps defining a display position for the articles to be dispensed, tray means movable in said space and adapted to apply pressure on the articles loaded into said space and to hold the last-to-be-loaded article in the display position so that when such article is moved relatively thereto, the force exerted by said tray causes the same to pop-out from said display position to be guided by said dispensing area to said dispensing position.

12. The dispenser of claim 11, said tray means including spring means in the form of a coiled tape one end of which is attached to said tray, the other end of which remains coiled and is held on said partition means near the lower edge thereof and outboard of said space.

* * * * *